US006454098B1

(12) United States Patent
Dewald et al.

(10) Patent No.: US 6,454,098 B1
(45) Date of Patent: Sep. 24, 2002

(54) MECHANICAL-PNEUMATIC DEVICE TO METER, CONDITION, AND CLASSIFY CHAFFY SEED

(75) Inventors: Chester L. Dewald, Woodward; Victor A. Beisel, Fargo, both of OK (US)

(73) Assignees: The United States of America as represented by the Secretary of Agriculture, Washington, DC (US); Aaron's Engineering, Fargo, OK (US)

( * ) Notice: Subject to any disclaimer, the term of this patent is extended or adjusted under 35 U.S.C. 154(b) by 0 days.

(21) Appl. No.: 09/875,484

(22) Filed: Jun. 6, 2001

(51) Int. Cl.[7] ..... B07B 9/02; B07B 7/086; B07B 1/20

(52) U.S. Cl. ..... 209/135; 209/33; 209/143

(58) Field of Search ..... 209/135, 143, 209/137, 149, 33, 30, 31, 257

(56) References Cited

U.S. PATENT DOCUMENTS

| | | | | | |
|---|---|---|---|---|---|
| 2,080 | A | * | 5/1841 | Philips et al. | 209/135 |
| 469,559 | A | * | 2/1892 | Groom | 209/135 |
| 799,113 | A | * | 9/1905 | Titzel | 209/135 |
| 1,114,619 | A | * | 10/1914 | James | 209/30 |
| 1,119,950 | A | * | 12/1914 | Harrington | 209/143 |
| 1,525,760 | A | * | 2/1925 | Rushton | 209/137 |
| 2,062,626 | A | * | 12/1936 | Williams et al. | 209/143 |
| 2,681,476 | A | * | 6/1954 | Van Doorn | 209/33 |
| 2,681,477 | A | * | 6/1954 | Van Doorn | 209/143 |
| 2,834,061 | A | * | 5/1958 | Van Doorn | 209/135 |
| 2,861,299 | A | * | 11/1958 | Day | 209/33 |
| 2,866,547 | A | * | 12/1958 | Gladfelter et al. | 209/137 |
| 3,087,615 | A | * | 4/1963 | Powell | 209/33 |
| 3,368,677 | A | * | 2/1968 | Bradley | 209/30 |
| 4,026,437 | A | | 5/1977 | Biddle | |
| 4,159,942 | A | * | 7/1979 | Greer et al. | 209/143 |
| 4,249,343 | A | | 2/1981 | Dannelly | |
| 4,344,843 | A | * | 8/1982 | Leifeld | 209/143 |
| 4,462,722 | A | * | 7/1984 | Reba | 406/154 |
| 4,505,196 | A | | 3/1985 | Beisel | |
| 4,533,469 | A | | 8/1985 | Beisel | |
| 4,657,667 | A | | 4/1987 | Etkin | |
| 4,801,374 | A | * | 1/1989 | Harold | 209/135 |
| 4,853,112 | A | * | 8/1989 | Brown | 209/142 |
| 4,872,972 | A | | 10/1989 | Wakabayashi et al. | |
| 4,933,072 | A | * | 6/1990 | Beisel | 209/142 |
| 5,525,510 | A | | 6/1996 | McCabe et al. | |
| 5,542,612 | A | | 8/1996 | Beisel | |
| 5,725,102 | A | | 3/1998 | Gustavsson | |
| 6,015,648 | A | | 1/2000 | Mitsumura et al. | |
| 6,253,923 | B1 | * | 7/2001 | Felkins | 209/137 |

FOREIGN PATENT DOCUMENTS

| | | | | |
|---|---|---|---|---|
| DE | 245654 | * | 11/1946 | 209/143 |
| DE | 2642884 | * | 3/1978 | 209/143 |
| EP | 0266778 | * | 5/1988 | 209/143 |
| FR | 1026035 | * | 10/1953 | 209/137 |
| SU | 0865430 | * | 9/1981 | 209/143 |

* cited by examiner

*Primary Examiner*—Donald P. Walsh
*Assistant Examiner*—Daniel K Schlak
(74) *Attorney, Agent, or Firm*—M. Howard Silverstein; Randall E. Deck; John D. Fado

(57) ABSTRACT

An apparatus and method for conditioning and/or classifying seed is disclosed. The apparatus includes a seed conditioning/classification unit having an acceleration conduit and a convexly curved Coanda surface provided adjacent to the conduit at its outlet, curving upwardly therefrom. As the crude particulate feed stream is discharged from the outlet, it is conditioned by the Coanda effect into a first outlet stream of entraining gas and lightweight extraneous materials, which is channeled approximately along or parallel to the Coanda surface, and a second stream of relatively heavier materials such as seeds, which is expelled approximately parallel to the central axis of the conduit at the outlet. Seeds which are expelled from the conduit are also classified by momentum discrimination.

24 Claims, 7 Drawing Sheets

MECHANICAL-PNEUMATIC DEVICE TO METER, CONDITION, AND CLASSIFY CHAFFY SEED

BACKGROUND OF THE INVENTION

1. Field of the Invention

The invention is drawn to an apparatus for improving both seed quality and the flow characteristics of difficult to handle, entangled seed material.

2. Related Art

Unprocessed seed, such as the seed of various grasses, is usually a heterogeneous mix of stems, leaves, chaff, awns, hairs, empty glumes, and seed of various size and quality. Natural dispersal agents such as hairs and awns tend to cling to each other, bridging-over and causing the seed to adhere in a mass. These masses make uniform dispensing and placement during planting difficult. Moreover, gravitational separation of the seeds by differential mass and densities often occurs during seed storage and transport, and particularly in the drill box, often resulting in non-uniform seeding rates and stand failures. Extensive and costly processing of the seed is typically required to produce a product which is clean and substantially pure.

Prior processes for the treatment of chaffy seed grasses have included the use of a hammer mill to chop up or break-up the grass stem, with subsequent seed cleaning treatments to debeard and deglume the seed. However, the efficacy of hammer mills is typically low, and such devices may damage the seed. Examples of previously known devices including some of the general structural and operational features of the instant invention are disclosed in U.S. Pat. Nos. 640,793, 2,011,365, 2,416,008, 3,087,618, 3,347,373, 3,837,490, 4,030,606 and 4,340,469.

More recently, Beisel (U.S. Pat. No. 4,533,469) has developed an apparatus for removing stems and cleaning (i.e., degluming and debearding) grass seeds without seed damage. Removal of stems and cleaning is effected in this apparatus by a rotating cylindrical drum having a wire mesh body, which operates in cooperation with a vibrating, elongated sieve assembly. Beisel has also developed an apparatus for cleaning and classifying seeds utilizing a skewed Coanda jet effect. A seed stream is accelerated and discharged horizontally through a duct having a downwardly curved trough or Coanda surface at its outlet. Light materials such as seed hulls and trash follow a low trajectory and are separated from the heavier particles such as seeds, which follow progressively higher trajectories.

However, despite these improvements, the need persists for devices effective for conditioning and classifying seed.

SUMMARY OF THE INVENTION

We have now invented an apparatus and method for conditioning and/or classifying seed utilizing the Coanda effect and momentum discrimination. The invention is particularly useful for separating whole, chaffy seeds from lightweight extraneous material such as one or more of lint, dust, fuzz, chaff, and trash. The apparatus includes a seed conditioning/classification unit having a conduit which is defined by upper and lower surfaces and which has an outlet at one end. The central axis of the conduit at this outlet is generally horizontal. An inlet to the conduit is spaced upstream from the conduit's outlet for providing a crude particulate feed stream of the material to be conditioned which is entrained in a pressurized gas stream. To effect conditioning and classification, a convexly curved Coanda surface is provided adjacent to and curving upwardly from the upper surface of the conduit at the outlet. As the crude particulate feed stream is discharged from the outlet, it is conditioned (i.e., separated) by the Coanda effect into a first outlet stream of the entraining gas and lightweight extraneous materials, which is channeled approximately along or parallel to the Coanda surface, and a second stream of relatively heavier materials such as seeds, which is expelled approximately parallel to the central axis of the conduit at the outlet. Moreover, the seeds which are expelled from the conduit are also classified (i.e., separated into discernible fractions of seeds of different densities) by momentum discrimination, with higher density, high quality seeds being propelled farther from the conduit outlet than seeds of lower quality and density.

When handling unprocessed chaffy seed, particularly tough chaffy seeds such as Texas bluegrass, which tend to adhere together and form dense seed clumps, the apparatus preferably further includes a preconditioning unit and/or raw seed feed metering device or conveyor. The preconditioning unit is adapted for breaking up small seed clumps and for dislodging hairs, awns, and extraneous appendages from whole seed which are typically present in a chaffy seed material. Pre-conditioned seed from this unit may then be used as the feed for the conditioning/classification unit. A raw seed conveyor may also be provided for delivering the raw seed to the pre-conditioning unit. The conveyor may be adapted for shearing large clumps of seed into individual seeds or smaller fractions which may be metered into the preconditioning unit at a uniform rate.

In accordance with this discovery, it is an object of this invention to provide an improved apparatus and method for conditioning and/or classifying seed, particularly seeds of grasses and most particularly of chaffy seed grasses.

Another object of this invention is to provide an apparatus and method for removing and separating lint, dust, fuzz, chaff, and other trash from seeds.

Yet another object of this invention is to provide an apparatus and method for classifying seed.

Still another object of this invention is to provide an apparatus and method for producing free-flowing seed of uniform size and quality.

These and other objects and advantages of the invention will become readily apparent from the ensuing description.

DETAILED DESCRIPTION OF THE INVENTION

The apparatus and method of this invention are effective for conditioning and classifying particulate materials of different densities. While the invention is suitable for separating a variety of particles of interest, it is particularly effective for treatment of seeds, including but not limited to the seeds of grasses and most particularly of chaffy seed grasses. Depending upon the seed type and its condition, seeds treated in accordance with this invention may be both conditioned, that is the seed may be cleaned of or separated from extraneous material such as lint, dust, fuzz, and chaff, and the the seeds may also be classified or separated by density.

Figure 1:
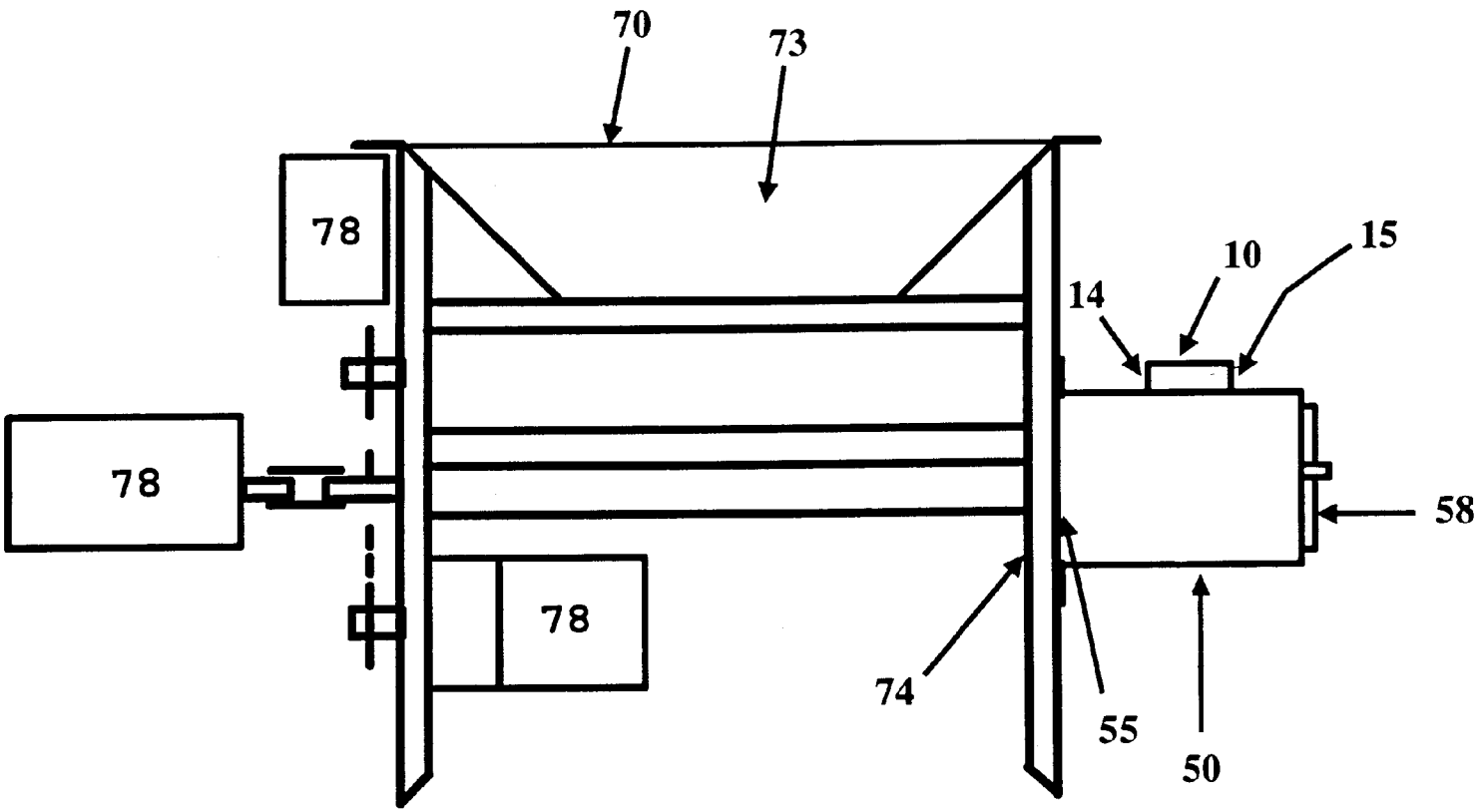
FIG. 1 is a side view of a preferred embodiment of the apparatus of the invention which includes a feed conveyor, preconditioning unit, and conditioning/classifying unit.

FIG. 1 shows the preferred apparatus of the invention used for the treatment of tough chaffy seeds such as Texas bluegrass. Not only does unprocessed seed of this type usually include trash and extraneous materials, but the seeds themselves have fine hairs and awns with attracting electric charges which cause them to adhere to one another in large masses which will not flow through conventional devices, resulting in fouling. To prepare a uniformly high quality, conditioned seed from this material, the apparatus includes a feed conveyor 70 for dispensing and conveying the unprocessed seed in uniform, metered amounts, a pre-conditioning unit 50 for removing extraneous seed appendages (e.g., awns, hairs, and fuzz) as well as stems and debris from the seed, and a conditioning/classifying unit 10 which both separates the extraneous material from the cleaned seed, and classifies the seed into quality classes based upon their density. Each of these components are combined into a self-contained, unitized system.

Figure 2:
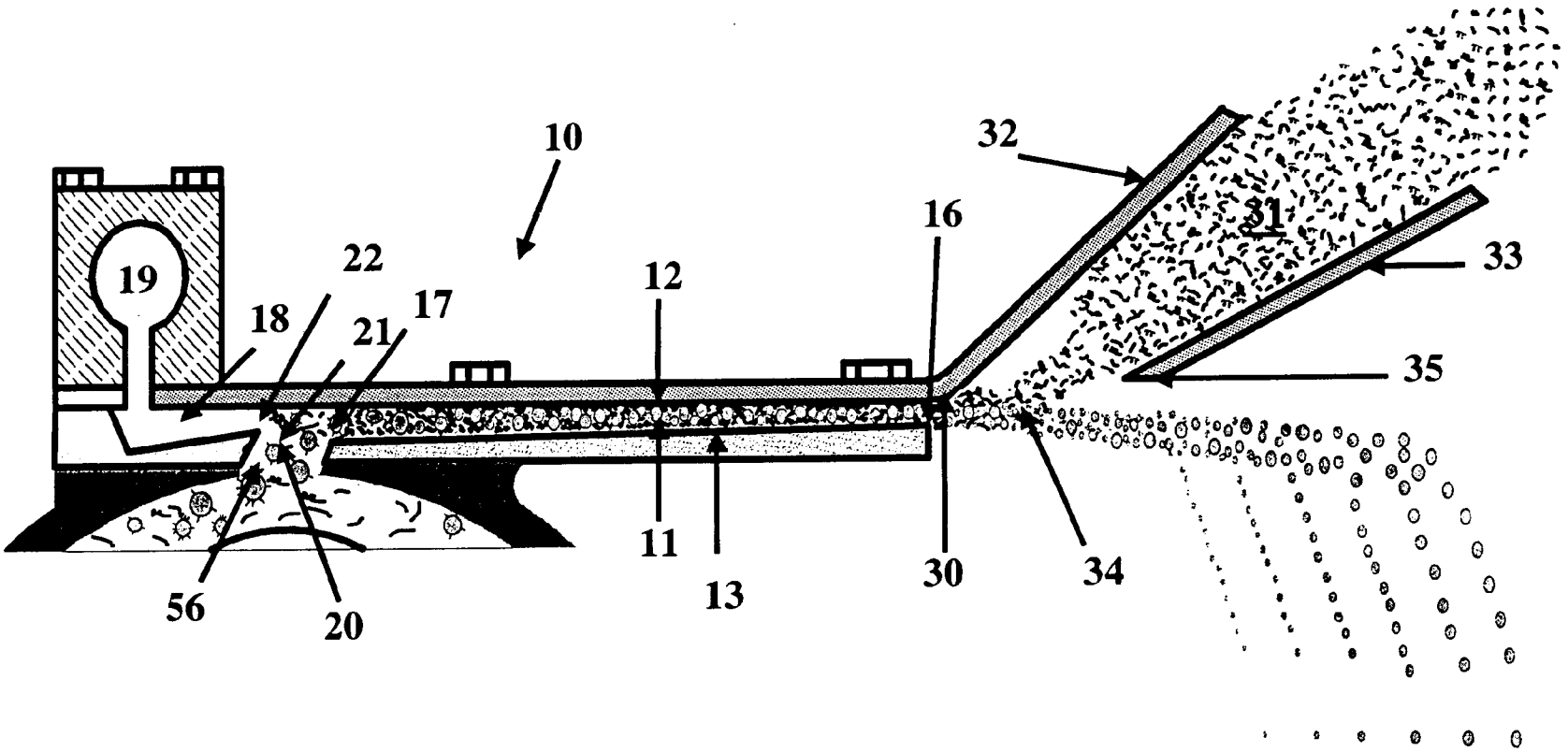
FIG. 2 is a cross-sectional end view of a conditioning/classifying unit of the invention, coupled to a preconditioning unit.
Figure 3:
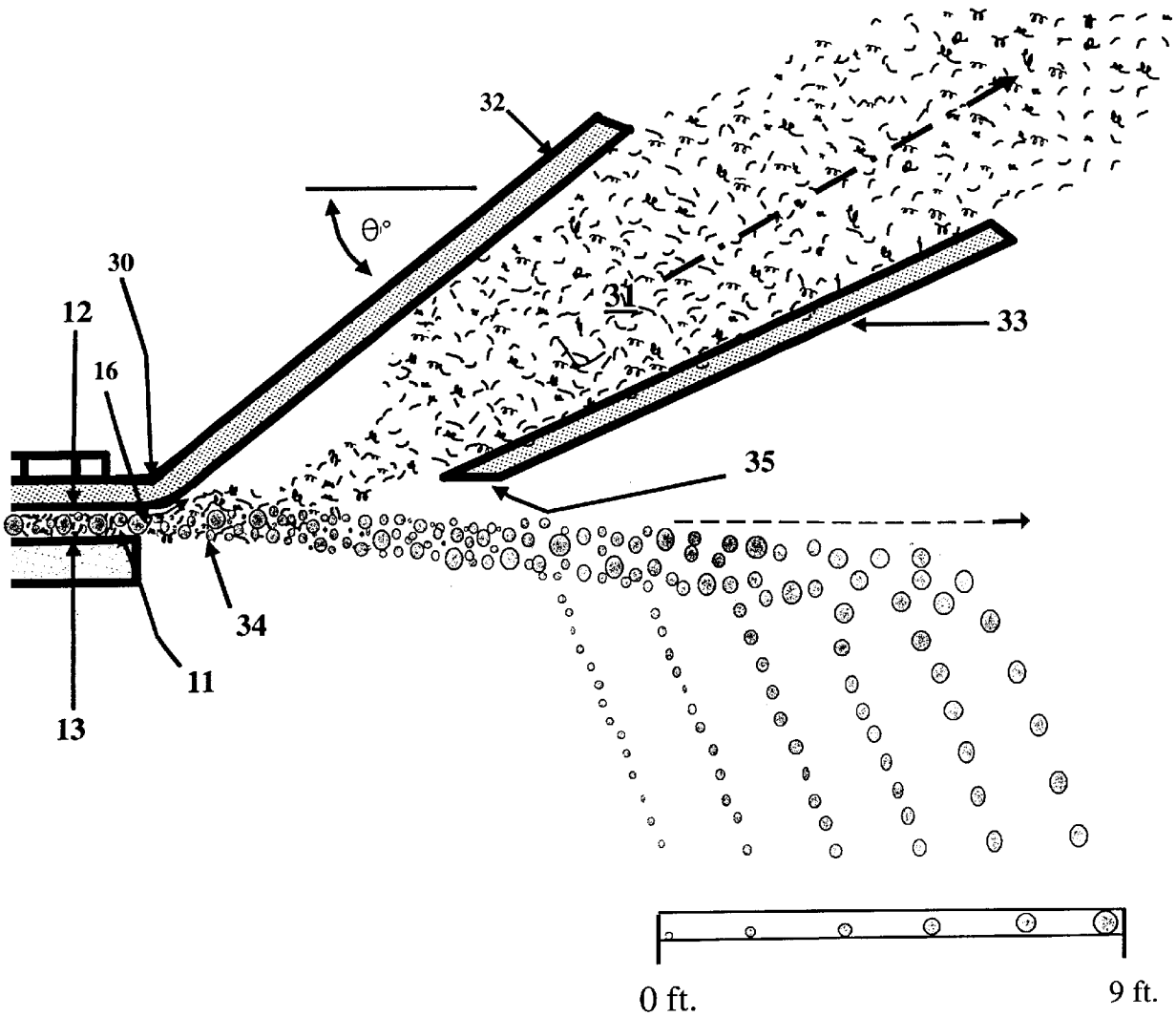
FIG. 3 is an expanded cross-sectional end view of the conditioning/classifying unit of FIG. 2.

While each of the components are described in greater detail hereinbelow, the following overview is presented to provide insight into the relationship therebetween in a preferred embodiment. This brief description is intended only for illustration and is not limiting in scope. In brief, the unprocessed, raw chaffy seed is delivered into feed conveyor 70 having paired adjacent horizontal feed augers 75 and 76 (FIGS. 6 and 7), which rotate towards each other on their upper surface to grasp the unprocessed seed between them in quantitative amounts and at a predetermined rate. While being held between the parallel feed augers, the unprocessed seed is lowered into a seed delivery auger 71, which shears off small quantitative amounts of the seed material and conveys them in a separated state to the pre-conditioning unit 50. Within the preconditioning unit, paddles 59 (FIGS. 4 and 5) rotate within a cylindrical scalping screen 53, agitating the seeds and forcing the same through the screen to dislodge hairs, awns, and extraneous appendages therefrom. Seeds forced through the scalping screen pass into an air circulation area 54 between the screen and the housing of the pre-conditioning unit. Seed and extraneous material in this air circulation area are then entrained by vacuum or suction through outlet 56 and into the inlet 20 of the conditioning/classification unit 10 for further conditioning and classification. The seed conditioning/classification unit includes a horizontal conduit 11 which converges toward its outlet 16 (FIGS. 2 and 3). The crude particulate feed stream from the pre-conditioning unit is accelerated in the conduit 11 by venturi action to the outlet 16, whereupon it is conditioned and classified by the action of the convexly curved Coanda surface 30. As the crude particulate feed stream is discharged from the outlet, a first outlet stream of the entraining gas with the lightweight extraneous materials is channeled along or parallel to the Coanda surface, while a second stream of relatively heavier materials such as seeds is expelled parallel to the central axis of the conduit. The expelled seeds are also classified by momentum discrimination into fractions of seeds of different densities.

Although the apparatus described above relates to a preferred embodiment for the treatment of chaffy seed grasses, it is understood that the conditioning and/or classification of other particles, including non-chaffy seeds which are not susceptible to clumping, may be conducted without one or both of a feed conveyor or a pre-conditioning unit, or using alternative embodiments as described below.

Referring now to FIGS. 2 and 3, the conditioning/classifying unit 10 includes a convergent conduit 11 defined by an upper surface 12 and lower surface 13 joined by opposed sides 14 and 15 (FIG. 1), and an outlet 16 at one end for discharge of the particulate material. The conduit 11 is disposed such that its central axis at the outlet 16 (shown as the extended dashed arrow in FIG. 3) is generally horizontal. Crude particulates for treatment in the unit are admitted into conduit 11 through an inlet 17 spaced upstream from the outlet 16. In a preferred embodiment, inlet 17 for the crude particulate feed stream includes a first inlet 18 for a pressurized or high velocity gas stream from source 19 and a second inlet 20 for the crude particulate feed stream to be treated. It is envisioned that inlet 20 may be provided at any position around the circumference of conduit 11 whereby the crude particulate feed stream may be delivered into the path of the gas stream. However, in the preferred embodiment, the crude particulate feed stream is entrained into a pressurized gas stream using a suction ejector or venturi.

A variety of suction ejectors and venturis are suitable for use herein. In a preferred embodiment, the apparatus includes a suction ejector 21 having a narrow nozzle 22, downstream from pressurized gas source 19, which opens into conduit 11. The second inlet 20 for the particulate feed is positioned adjacent to the tip of this nozzle 22. The pressurized gas expands in nozzle 18, changing from high pressure to high velocity gas as it exits opening 22 and enters conduit 11. The high velocity gas passing over opening 20 creates a vacuum or suction which entrains ambient air and suspended particulate material (including seed) therein and into the conduit. The air entrained particulate material enters and expands in the conduit 11 where it becomes pressurized and exits at outlet 16 at increased velocity.

Alternatively, rather than use of suction ejection, the crude particulate stream may be delivered into the path of the gas stream, for example, by pneumatic or mechanical conveyance, or it may be dispensed into the gas stream by gravity. The skilled practitioner will recognize that other alternative configurations of inlet 17 may be utilized without separate inlets for the gas and particulate material. For instance, the stream of particulate material entrained in the gas may be generated remotely from the conditioning/classification unit and admitted through a single inlet 17.

To separate extraneous material or light debris such as lint, dust, fuzz, chaff, and other trash from the heavier particles such as seeds in the feed stream, a convexly curved Coanda surface (also referred to as a Coanda radius) 30 is provided adjacent to the upper surface 12 of the conduit at the outlet 16, curving upwardly from this upper surface. As a stream of crude particulates is discharged from the outlet 16 and passes across the Coanda surface 30, the Coanda effect lifts the entraining gas stream upwards in the direction of the curvature of the Coanda surface and away from the original direction of travel. The lightweight extraneous material is entrained with the gas and removed from the system. In contrast, relatively heavier particulate materials, such as seeds, are propelled forward from the outlet 16, free from both the lightweight extraneous material and the entraining gas. Thus, the crude particulate stream discharged from outlet 16 is separated into a first outlet stream including the entraining gas and the relatively lightweight extraneous material which is channeled approximately along or parallel to the Coanda surface, and a second outlet stream of the heavier particulate material which is expelled approximately parallel to the central axis of the conduit at the outlet. In addition to conditioning, the heavier particulate material or seed is also classified by momentum discrimination. This classification is described in greater detail hereinbelow.

The angle of curvature θ of the Coanda surface will typically vary somewhat with the particles and extraneous material being separated. Suitable Coanda surfaces should be capable of providing an effective degree of lift for conditioning and classifying a mixed or crude particulate feed material stream as it is discharged from the outlet 16 of conduit 11. An effective degree of conditioning is defined herein as a level of removal or separation of lightweight extraneous material, which may itself be completely or partially particulate in nature, from relatively heavier particulates in a crude particulate feed material which is substantially greater than the control (untreated) crude particulate feed. Similarly, an effective degree of classification is defined herein as that level producing at least two fractions of particles of different densities from a crude particulate feed material. The optimum angle of the Coanda surface may be determined by routine experimentation. Without being limited thereto, for the conditioning and classification of grass seeds, preferred angles of inclination for the Coanda surface vary between about 20° to 45°, particularly between about 30–45°, and most particularly between about 40–42° (inclination measured relative to the upper surface of the conduit at the outlet). The Coanda surface may be spaced from the upper surface 12 of conduit 11 at the outlet 16, but is preferably contiguous therewith as shown.

The shape and dimensions of the conduit 11 should be sufficient to allow passage of the particulate feed stream therethrough. In the preferred embodiment, the conduit 11 is a venturi, with its internal cross sectional area decreasing toward the outlet 16, to accelerate the crude particulate feed entrained in the pressurized gas stream. In a particularly preferred but non-limiting embodiment, the upper and lower surfaces 12 and 13 are substantially planar and are convergent or tapered toward the outlet 16. The outlet 16 in this embodiment has a rectangular cross section, with the preferred distance between the first and second surfaces thereat ranging between about 1.25 to 6.25 mm. The precise position and level of central axis of the conduit 11 at the outlet 16 is also variable, and seeds may be both effectively conditioned and classified with the axis disposed in a range of ±20° from true horizontal. In the preferred embodiment, the axis will be positioned within ±10° of true horizontal, and in the particularly preferred embodiment it is horizontal. Conditioning of the seed may still be effected at angles of inclination greater than 20° owing to the Coanda effect and the tendency of the air stream and entrained light material (such as lint, dust, fuzz, and chaff) to follow the Coanda surface. However, the classification of the seeds into discernible fractions of different densities becomes more difficult with increasing inclination of the conduit beyond this range due to the decreased linear separation between the fractions. For conditioning chaffy seed grasses in a unit of these dimensions, pressurized gas source 19 is preferably adjusted to deliver entraining gas at approximately 60 cfm at 40 psi.

Collection or venting of the extraneous lightweight material or trash which have been separated from the crude particulate feed stream may be facilitated by providing an optional chamber or channel in the path of the first stream, downstream from the Coanda surface. In the preferred embodiment shown in FIG. 1, an outlet channel 31 is defined by an additional surface 32 and baffle 33 extending away from the outlet 16. Additional surface 32 is positioned adjacent to and extending from Coanda surface 30 (on the opposite side thereof from the outlet 16). To allow ingress of ambient air near the outlet 16 and Coanda surface 30, while allowing discharge of the second outlet stream containing the seeds or other heavy particulate materials, baffle 33 is spaced from the terminus of the lower surface 13 at the outlet 16, forming a slot 34 therebetween. Baffle 33 should not block or impede the discharge of the second outlet stream from the outlet 16. Thus, the end 35 of baffle 33 which is proximal to outlet 16 is preferably positioned intermediate between additional surface 32 and a straight line which is collinear with and extends from the central axis of the conduit at the outlet 16. Although outlet channel 31 may be open at the sides, it is preferably closed, with the sides of additional surface 32 and baffle 33 being joined. Outlet channel 31 may be further connected to an optional container or additional conduit(s) for exhaust or collection of the first outlet stream.

The size of the slot 34 is not critical, and need only be of sufficient size to allow passage of the second outlet stream therethrough after it is discharged from the outlet 16, while allowing ingress of air to the Coanda surface and outlet channel 31. Without being limited thereto, in the preferred embodiment the slot length, measured as the lateral distance from the outlet 16 to the proximal end 35 of baffle 33, is approximately 75 mm. The size and dimensions of the outlet channel 31 also are not critical, and need only be sufficient to allow passage of the first outlet stream therethrough. Without being limited thereto, the additional surface 32 and baffle 33 are typically substantially planar, with a spacing therebetween ranging between about 40 to 80 mm or greater, most preferably the spacing is about 55 mm. In a preferred embodiment shown in FIG. 1, the cross sectional area of the outlet channel 31 increases downstream or in a direction away from the outlet 16, such that the outlet channel is generally V shaped. Use of a V shaped outlet channel allows the first outlet stream to expand, thereby reducing its velocity and increasing the pressure needed to move the stream through any additional downstream conduits.

Although the conditioning/classifying unit 10 of the invention may be provided and used as a stand alone device, in the preferred embodiment it is used in combination with an optional pre-conditioning unit and/or feed conveyor. Indeed, as mentioned above, for conditioning tough, chaffy seed grasses such as Texas bluegrass, we have found that it is necessary to use both the preferred pre-conditioning unit and feed conveyor to prevent fouling of the device. Both conditioning and classification of seed are enhanced by pretreatment of a raw, unprocessed seed in a pre-conditioning unit effective for breaking up seed clumps and dislodging hairs, awns, and extraneous appendages which are typically present on chaffy seeds. In the preferred embodiment, the pre-conditioning unit includes a scalping chamber having a perforated wall with a agitator positioned therein adapted to forcefully direct a raw feed material against the inner surface of the perforated wall, and an outer collection chamber for collecting the feed passing or expressed through the perforations. As the seeds are pressed against the perforated wall and through the perforations therein, awns, hair, fuzz and other extraneous appendages are dislodged or sheared from the surface of the seeds. Large debris does not pass through the perforations and may be removed.

Figure 4:
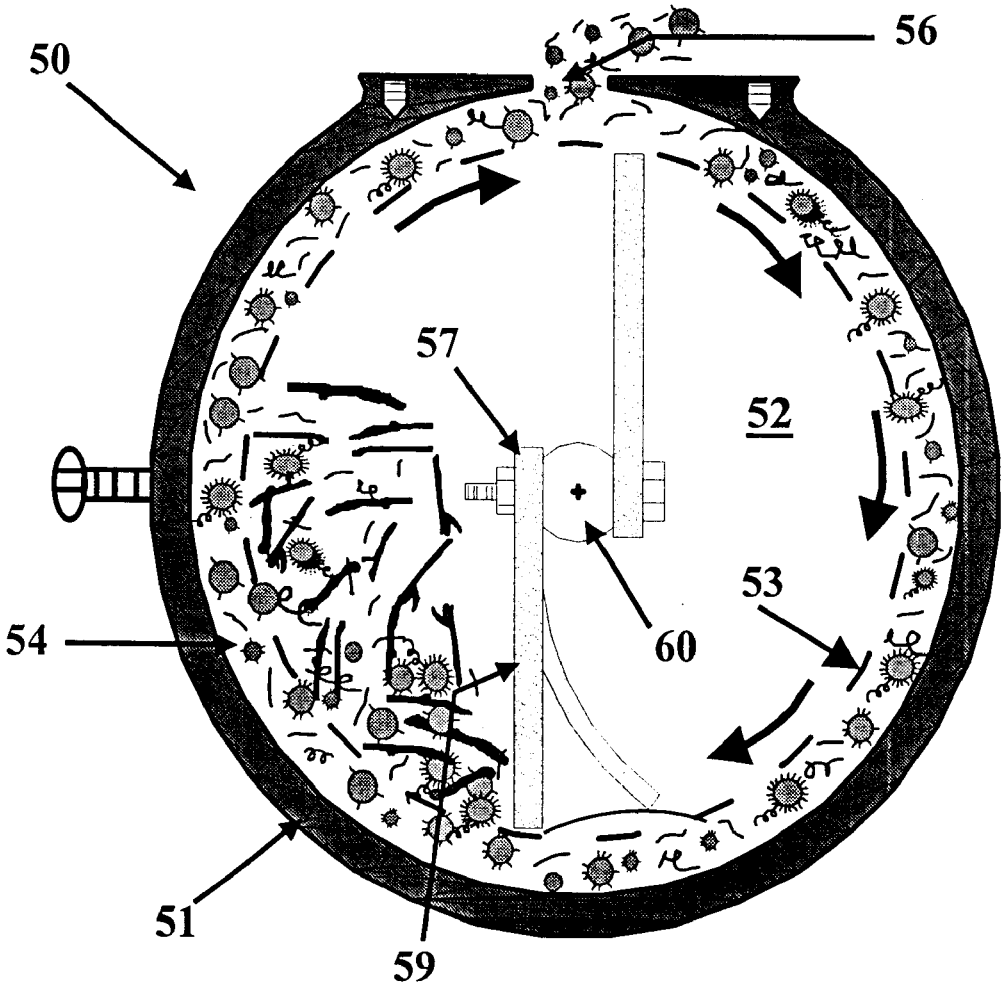
FIG. 4 is a cross-sectional end view of a pre-conditioning unit of the invention.
Figure 5:
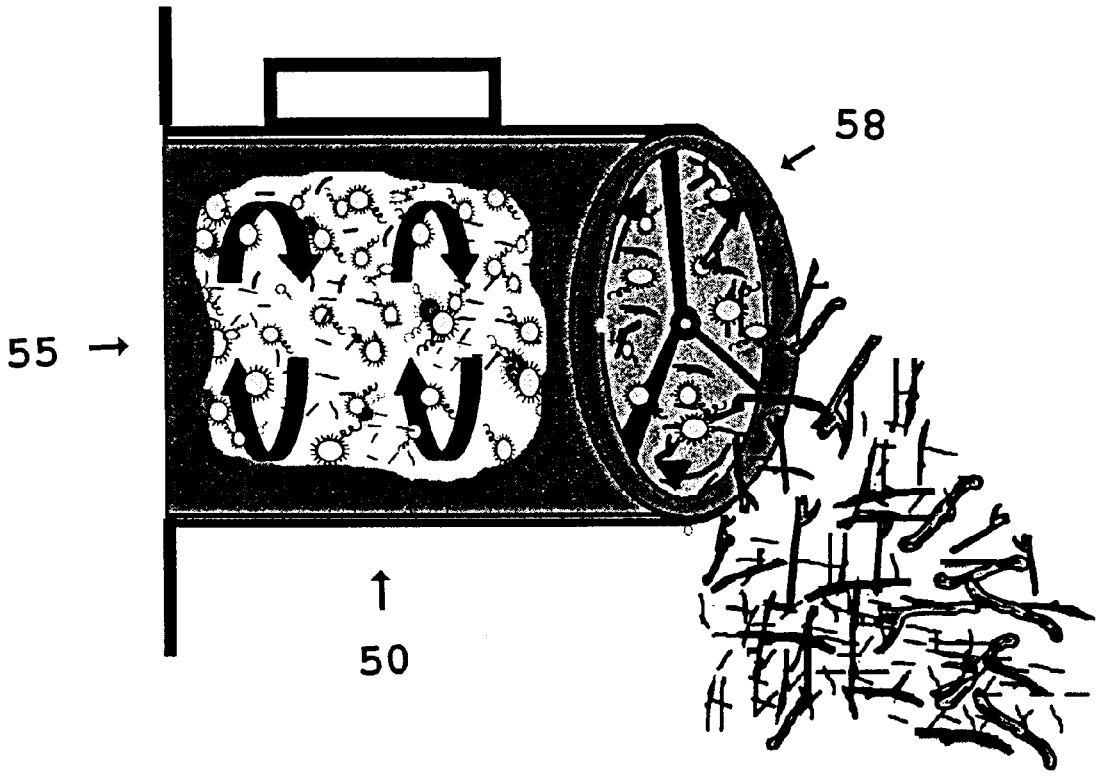
FIG. 5 is a perspective view of the pre-conditioning unit of FIG. 4.

A particularly preferred pre-conditioning unit is shown in FIGS. 4 and 5. As shown therein, the pre-conditioning unit 50 includes an outer collection chamber or housing 51, within which is disposed scalping chamber 52. Scalping chamber 52 has an inner perforated wall 53 having a diameter smaller than the interior of the housing 51, thereby forming an interstitial space 54 which is of sufficient size to allow flow or circulation of seeds therein. The size of the perforations or openings in perforated wall 53 may vary with the particular seeds of interest, and are selected to allow the passage of individual, whole seeds therethrough while substantially preventing the passage of clumps containing a plurality of seeds. Preconditioning unit 50 further includes an inlet 55 at one end of the housing for delivering raw seed into the interior of scalping chamber 52, and a first outlet 56 from housing 51 for removing seeds which have passed into the interstitial space 54. To urge the raw seeds deposited within the scalping chamber 52 to pass through the perforations in wall 53, an agitator 57 is provided within the scalping chamber which is effective for forcefully directing said raw seed material against the interior of the perforated wall. Seeds and other smaller extraneous material which pass through the perforated wall 53 into interstitial space 54 are then moved through outlet 56 and into inlet 17 of conduit 11. Circulation of the seeds in interstitial space 54 toward the outlet 56 may be assisted by placement of optional air or gas jets in housing 51. Such jets are preferably positioned to discharge the air into the interstitial space 54 at an angle to a line normal to the interior wall of the housing. A second outlet 58 from the scalping chamber 52 may also be provided on the end of the housing opposite from inlet 55, for removing large debris such as stems, trash, and rocks which do not pass through the perforated wall 53.

The shapes of the housing 51, scalping chamber 52, and agitator 57 are not critical and may vary with the particulate being treated. However, in the preferred embodiment shown in the Figures, the housing and scalping chamber are substantially cylindrical, with the scalping chamber being positioned substantially coaxially within the housing, eliminating corners or dead spaces where seeds could accumulate. The perforated wall 53 of the scalping chamber may be produced from a continuous material such as sheet metal, but is preferably a screen, grid, or mesh. The agitator 57 preferably includes at least one rotating sweep or paddle 59 attached to a central shaft 60, positioned with its outermost edge near or adjacent to the interior surface of the perforated wall 53. Although paddles 59 may be rigid or flexible, and may be constructed from a variety of materials, they are preferably flexible rubber. Alternatively, agitator 57 may be constructed as a rotating polygon, screw (e.g., an extruder screw), brushes, or eccentric cylinder), with its outermost edges adjacent to or near the interior wall of perforated wall 53. Further, it is also understood that rather than using a rotating agitator, the scalping chamber 52 may rotate and the agitator may be stationary or moving at a different velocity.

Outlet 56 may be in direct or indirect communication with the inlet of the conditioning/classification unit 10. In the preferred embodiment, outlet 56 is in direct communication with inlet 17, particularly second inlet 20 thereof. In the particularly preferred embodiment for the treatment of tough chaffy seeds, outlet 56 is positioned at approximately the top of housing 51, while second inlet 20 of conduit 11 is positioned approximately on the bottom thereof. In this embodiment, pressurized gas discharged from nozzle 22 will draw the seed material from the interstitial space adjacent to outlet 56 into second inlet 20 and conduit 11, whereupon it will be entrained toward outlet 16.

Delivery of the raw seed to the pre-conditioning unit may be provided by use of an optional feed conveyor 70. In the preferred embodiment, feed conveyor includes a rotating feed screw or auger 71 (feed delivery auger) in a container, hopper, or trough 72 having a raw seed feed inlet 73 and outlet 74 in communication with inlet 55 of scalping chamber 52. The shaft of feed auger 71 may be an extension of shaft 60 of the pre-conditioning unit. The direction of rotation of feed auger 71 is selected to deliver or carry the raw seed feed toward the outlet 74 and hence to the inlet of the scalping chamber. A pair of variable-drive, counter-rotating screws or augers 75 and 76 which are larger than feed auger 71 may also be provided above feed auger, with the feed auger is positioned below the space or interface 77 between augers 75 and 76. All of the augers are preferably approximately horizontal, and may be powered by one or more motors 78.

Figure 6:
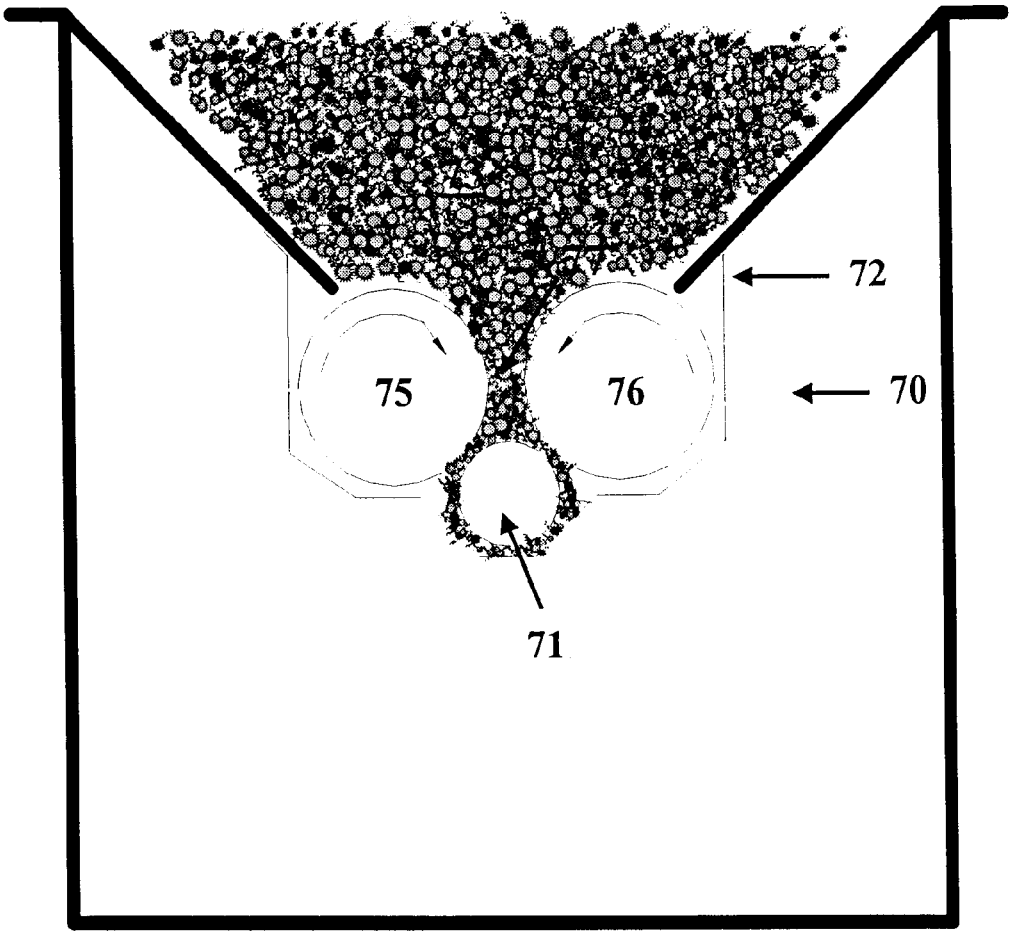
FIG. 6 is a cross-sectional end view of a feed conveyor of the invention.
Figure 7:
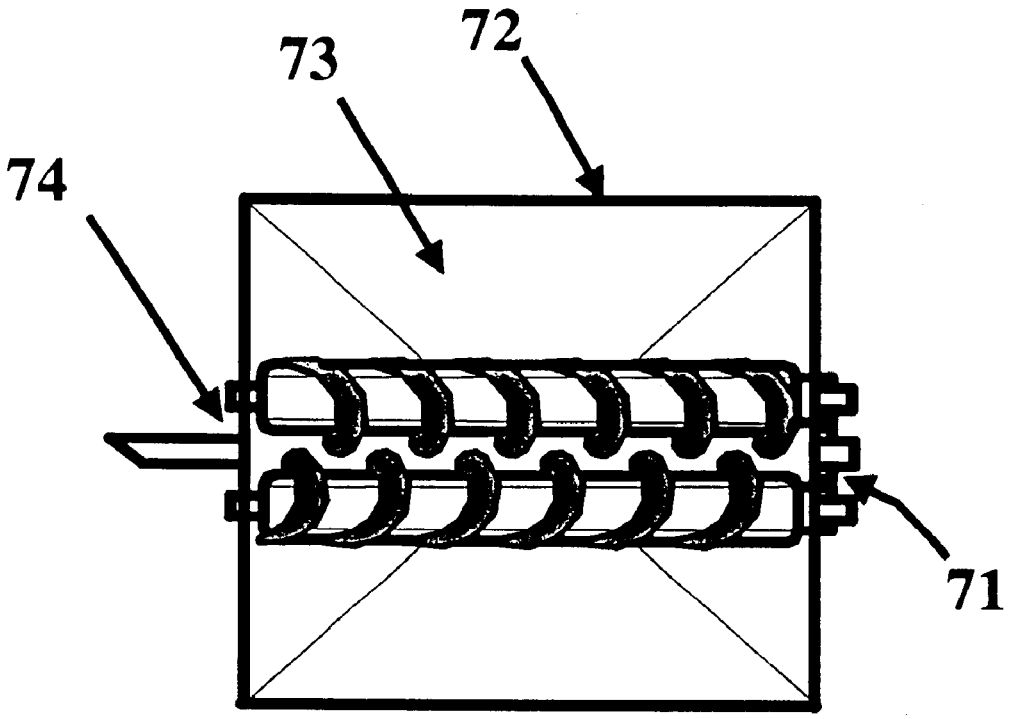
FIG. 7 is a top view of the feed conveyor of FIG. 6.

Augers 75 and 76 are positioned with their axes substantially parallel, and their outer edges closely spaced from one another and nearly touching, and are adapted or constructed to rotate in opposite directions and towards each other on their upper surfaces as shown in FIG. 6. The spacing and speed of rotation of augers 75 and 76 may be determined by the practitioner, but are preferably effective to shear seed clumps into smaller fractions, without significantly damaging the seeds, as they are passed through interface 77 and onto feed auger 71 at a predetermined rate. The smaller feed auger 71 is adapted to turn at a higher rpm effective for further shearing the clumps into still smaller fractions and deliver the separated seed to the pre-conditioning unit 50. Without being limited thereto, for the treatment of tough chaffy seeds, the preferred speed of rotation of the feed auger 71 is between approximately 600 to 1200 rpm, while augers 75 and 76 operate between approximately 5 to 25 rpm.

While the above described pre-conditioning unit 50 and feed conveyor 70 are preferred for the processing of tough chaffy seeds, it is understood that a variety of alternative pre-conditioning units and/or feed conveyors may be suitable for use herein when processing non- or less chaffy seeds which are not susceptible to a significant degree of clumping, or other relatively free-flowing particulate materials. For instance, a variety of conventional size-reducing devices are suitable for use herein as pre-conditioning units including, but are not limited to, mills, crushers, and shredders, such as described by Snow et al. ["Size Reduction and Size Enlargement", In: Chemical Engineer's Handbook, Perry and Chilton (ed.), fifth ed., McGraw-Hill, New York, 1973, pp. 8–1 to 8–57], or inclined sieves such as described by Beisel (U.S. Pat. No. 4,533,469), the contents of each of which are incorporated by reference herein. Similarly, the particulate materials may also be conveyed to the preconditioning unit, for example, by a conventional conveyor belt, single or double screw feed, pneumatic feed, or gravity feed.

The apparatus and method of the invention are particularly suited for the treatment of crude seed mixtures comprising immature and mature whole seed and one or more of lint, dust, fuzz, and chaff. In use, raw seed is deposited into trough 72, whereupon counter-rotating augers 75 and 76 draw the seed through the interface 77, shearing the same into smaller clumps which fall onto feed auger 71. Feed auger 71 in turn carries the seed to outlet 74 and the pre-conditioning unit 50, whereupon the seed passes through outlet 74 directly into the interior of scalping chamber 52 through inlet 55. Within scalping chamber 52, the raw seed is contacted by rotating paddles 59, forcing the raw seeds against the interior of the perforated wall 53 and through the perforations, and thereby causing the seed clumps to be further broken into pieces small enough to pass therethrough while concurrently removing many of the hairs, awns, and other extraneous appendages on the seeds. Seeds and other extraneous lightweight materials passing through the scalping chamber into interstitial space 54 are then circulated toward outlet 56 and into inlet 17 (and 20) of the conditioning/classifying unit 10 by the combined action of the rotation of the scalping chamber, suction ejector 21, and the optional air jets. From the inlet 17, the seeds are entrained in the pressurized gas stream, and are accelerated as they pass through conduit 11. As this stream containing the crude seed mixture is discharged from the outlet 16, it is separated into first and second outlet streams by the Coanda effect exerted by Coanda surface 30. The Coanda effect lifts the gas stream upward in the direction of the Coanda bend and away from the original direction of travel. Lightweight materials lack sufficient momentum and are entrained with the gas stream. In contrast, heavier particles such as seed are propelled forward from outlet 16, free of the entraining gas stream. Consequently, the first outlet stream, which includes the entraining gas and extraneous lightweight material such as the lint, dust, fuzz, and chaff, is channeled approximately along or parallel to the Coanda surface 30, and continues through outlet channel 31 where it may be collected or discarded. However, the second outlet stream of relatively heavier particles such as whole seed, is expelled through slot 34, approximately parallel to the central axis of the conduit at the outlet 16.

Seed expelled through outlet 16 and slot 34 is separated from lightweight debris and trash originally present in the raw seed feed and may be collected as is for subsequent use. However, the seeds may also be readily classified into at least two, and preferably more, fractions of different densities prior to collection. As the seeds are expelled, those having the highest density (typically mature seeds of higher quality) are expelled the greatest distance from the outlet 16. Lower density seeds, are propelled shorter distances, with the lowest density seeds (e.g., low quality immature seeds), being propelled the shortest distance from the outlet, while seeds of moderate density (e.g., seeds of lower purity which may retain some attached glumes or other extraneous matter) are propelled to a distance intermediate between these two extremes. This moderate density fraction may be collected and recycled through the apparatus.

It is understood that the foregoing detailed description is given merely by way of illustration and that modifications and variations may be made therein without departing from the spirit and scope of the invention.

We claim:

1. An apparatus for conditioning or classifying seed or both comprising a pre-conditioning unit and a seed conditioning/classifying unit, said pre-conditioning unit comprising:

a. an outer collection housing;

b. a scalping chamber comprising a perforated wall disposed within said housing, said scalping chamber having a diameter smaller than the interior of said housing to provide an interstitial space which is effective to allow flow of seeds therebetween, said perforated wall of said scalping chamber comprising perforations effective for allowing the passage of individual, whole seeds therethrough while substantially preventing the passage of clumps containing a plurality of seeds;

c. an inlet to said scalping chamber for delivering raw seed material for treatment into the interior of said scalping chamber;

d. an agitator within said scalping chamber effective for forcefully directing said raw seed material against the interior of said perforated wall of said scalping chamber thereby breaking up seed clumps and dislodging hairs, awns, and extraneous appendages from whole seed in said raw seed material;

e. an outlet from said interstitial space of said housing for removing a crude particulate feed stream comprising whole seed and one or more of lint, dust, fuzz, and chaff which have passed through said perforated wall into said interstitial space; and said seed conditioning/classifying unit comprising:

f. a conduit defined by an upper surface and lower surface and having an outlet at one end, wherein the central axis of said conduit at said outlet therefrom is generally horizontal;

g. an inlet to said conduit spaced from said outlet of said conduit for providing said crude particulate feed stream entrained in a pressurized gas stream, said inlet to said conduit being in communication with said outlet from said interstitial space of said housing;

h. a convexly curved Coanda surface adjacent to said upper surface of said conduit at said outlet therefrom and curving upwardly from said upper surface, wherein said Coanda surface is effective for separating said crude particulate feed stream as it is discharged from said outlet of said conduit into a first outlet stream channeled approximately along said Coanda surface, and a second outlet stream expelled approximately parallel to said central axis of said conduit at said outlet therefrom, wherein said first outlet stream comprises said gas and one or more of said lint, dust, fuzz, and chaff, and said second outlet stream comprises whole seed.

2. The apparatus of claim 1 further comprising an additional surface adjacent to and extending from said convexly curved Coanda surface.

3. The apparatus of claim 2 further comprising a baffle spaced from said outlet of said conduit and forming a slot between said lower surface of said conduit and said baffle, said baffle having a first end proximal to said outlet of said conduit which said first end is positioned intermediate between said additional surface and a straight line extending from said outlet of said conduit which is collinear with said central axis of said conduit at said outlet therefrom, such that said baffle does not intersect or extend across said straight line, and further wherein said baffle extends in a direction away from said outlet of said conduit, said additional surface and said baffle defining an outlet channel for said first outlet stream while said second outlet stream is discharged through said slot.

4. The apparatus of claim 3 wherein the distance between said first end of said baffle and said additional surface is between about 40 to 80 mm.

5. The apparatus of claim 3 wherein the cross-sectional area of said outlet channel increases downstream from said outlet.

6. The apparatus of claim 1 wherein said first and second surfaces of said conduit are substantially planar.

7. The apparatus of claim 6 wherein a cross section through said conduit at said outlet therefrom is approximately rectangular.

8. The apparatus of claim 1 wherein the distance between said first and second surfaces of said conduit at said outlet therefrom is between about 1.25 to 6.25 mm.

9. The apparatus of claim 1 wherein said inlet to said conduit comprises a first inlet for said pressurized gas stream and a second inlet for said crude particulate feed, said second inlet being positioned downstream of said first inlet effective for entraining said crude particulate feed into said pressurized gas stream.

10. The apparatus of claim 9 wherein said first inlet for said pressurized gas stream comprises a nozzle convergent toward said outlet of said conduit and having a nozzle outlet upstream of said second inlet.

11. The apparatus of claim 10 wherein said second inlet is in the lower surface of said conduit.

12. The apparatus of claim 1 wherein said conduit is convergent toward said outlet therefrom and is effective for accelerating said crude particulate feed stream entrained in said pressurized gas stream as it is directed toward said outlet of said conduit.

13. The apparatus of claim 1 wherein said convexly curved Coanda surface comprises a Coanda angle of between about 20° to 45°.

14. The apparatus of claim 1 wherein said housing and said scalping chamber are substantially cylindrical, and said scalping chamber is coaxial with said housing.

15. The apparatus of claim 14 wherein said agitator comprises at least one rotating paddle, positioned with its outermost edge adjacent to the interior surface of said perforated wall.

16. The apparatus of claim 1 wherein said inlet to said conduit comprises a first inlet for said pressurized gas stream and a second inlet for said crude particulate feed stream, said second inlet being positioned downstream of said first inlet effective for entraining said crude particulate feed stream into said pressurized gas stream, and said outlet from said interstitial space of said housing is in communication with said second inlet for said crude particulate feed stream.

17. The apparatus of claim 16 wherein said second inlet is positioned approximately on the bottom of said conduit, said outlet from said interstitial space of said housing of said pre-conditioning unit is approximately at the top of said housing, and said second inlet and said outlet from said interstitial space of said housing are in direct communication with one another.

18. The apparatus of claim 1 further comprising a raw seed feed conveyor in communication with said inlet to said scalping chamber for delivering raw seed material for treatment into the interior of said scalping chamber.

19. The apparatus of claim 18 wherein said raw seed feed conveyor comprises:

a. a container having an inlet for said raw seed feed and an outlet in communication with said inlet to said scalping chamber;

b. a pair of substantially parallel, approximately horizontal, counter-rotating screw augers positioned within said container below said inlet of said container, the upper surfaces of said counter-rotating augers rotating towards each other, wherein said counter-rotating augers are positioned relative to one another with their outer edges spaced from one another a distance effective to shear seed clumps into smaller fractions as said seed clumps are passed through the space therebetween; and c. an approximately horizontal rotating feed auger positioned in said container below said space between said counter-rotating augers to receive seed, said feed auger rotating in a direction effective to deliver said raw seed feed to said outlet from said container.

20. The apparatus of claim 19 wherein said feed auger is smaller in diameter and rotates at a higher revolutions per minute than said counter-rotating augers.

21. The apparatus of claim 1 further comprising an outlet from said interior of said scalping chamber.

22. A method for conditioning seed comprising:

a. providing an apparatus for conditioning or classifying seed or both comprising a pre-conditioning unit and a seed conditioning/classifying unit, said pre-conditioning unit comprising:

1. an outer collection housing;
2. a scalping chamber comprising a perforated wall disposed within said housing, said scalping chamber having a diameter smaller than the interior of said housing to provide an interstitial space which is effective to allow flow of seeds therebetween, said perforated wall of said scalping chamber comprising perforations effective for allowing the passage of individual, whole seeds therethrough while substantially preventing the passage of clumps containing a plurality of seeds;
3. an inlet to said scalping chamber for delivering raw seed material for treatment into the interior of said scalping chamber;
4. an agitator within said scalping chamber effective for forcefully directing said raw seed material against the interior of said perforated wall of said scalping chamber thereby breaking up seed clumps and dislodging hairs, awns, and extraneous appendages from whole seed in said raw seed material;
5. an outlet from said interstitial space of said housing for removing a crude particulate feed stream comprising whole seed and one or more of lint, dust, fuzz, and chaff which have passed through said perforated wall into said interstitial space; and said seed conditioning/classifying unit comprising:

6. a conduit defined by an upper surface and lower surface and having an outlet at one end, wherein the central axis of said conduit at said outlet therefrom is generally horizontal;
7. an inlet to said conduit spaced from said outlet of said conduit for providing said crude particulate feed stream entrained in a pressurized gas stream, said inlet to said conduit being in communication with said outlet from said interstitial space of said housing;
8. a convexly curved Coanda surface adjacent to said upper surface of said conduit at said outlet therefrom and curving upwardly from said upper surface, wherein said Coanda surface is effective for separating said crude particulate feed stream as it is discharged from said outlet of said conduit into a first outlet stream channeled approximately along said Coanda surface, and a second outlet stream expelled approximately parallel to said central axis of said conduit at said outlet therefrom, wherein said first outlet stream comprises said gas and one or more of said lint, dust, fuzz, and chaff, and said second outlet stream comprises whole seed;

b. delivering said raw seed material into the interior of said scalping chamber;

c. rotating said agitator within said scalping chamber to agitate said raw seed material, forcefully directing said raw seed material against the interior of said perforated wall of said scalping chamber thereby breaking up seed clumps and dislodging hairs, awns, and extraneous appendages from whole seed in said raw seed material and forcing said whole seed through said perforated wall into said interstitial space;

d. moving said crude particulate feed stream from said interstitial space into said inlet of said conduit;

e. providing a pressurized gas stream to said inlet of said conduit effective for entraining said crude particulate feed stream through said conduit and said outlet of said conduit;

f. recovering said second outlet stream comprising whole seed separated from said first outlet stream expelled from said outlet of said conduit.

23. The method of claim 22 wherein said recovering of said second outlet stream further comprises classifying said seed by separately recovering said seed ejected at different distances from said outlet of said conduit.

24. The process of claim 22 wherein said seed comprises chaffy seed.

* * * * *